US005521016A

United States Patent [19]

Pyzik et al.

[11] Patent Number: 5,521,016

[45] Date of Patent: May 28, 1996

[54] LIGHT WEIGHT BORON CARBIDE/ALUMINUM CERMETS

[75] Inventors: Aleksander J. Pyzik; Uday V. Deshmukh; Stephen D. Dunmead, all of Midland; Jack J. Ott, Hemlock; Timothy L. Allen; Harold E. Rossow, both of Midland, all of Mich.

[73] Assignee: The Dow Chemical Company, Midland, Mich.

[21] Appl. No.: 377,559

[22] Filed: Jan. 24, 1995

Related U.S. Application Data

[63] Continuation-in-part of Ser. No. 154,904, Nov. 19, 1993, Pat. No. 5,394,929, which is a continuation-in-part of Ser. No. 916,041, Jul. 17, 1992, abandoned.

[51] Int. Cl.[6] ..... B22F 3/26

[52] U.S. Cl. ..... 428/568; 428/551; 428/552; 428/565; 419/5; 419/9; 419/8; 419/10; 419/38; 419/53

[58] Field of Search ..... 164/91, 97; 419/5, 419/8, 10, 9, 53, 38; 428/546, 548, 551, 552, 565, 568

[56] References Cited

U.S. PATENT DOCUMENTS

| | | | |
|---|---|---|---|
| 3,796,564 | 3/1974 | Taylor | 75/238 |
| 3,859,399 | 1/1975 | Bailey et al. | 264/29 |
| 3,864,154 | 2/1975 | Gazza | 264/60 |
| 4,605,440 | 8/1986 | Halverson et al. | 75/238 |
| 4,702,770 | 10/1987 | Pyzik et al. | 75/236 |
| 4,718,941 | 1/1988 | Halverson et al. | 75/236 |
| 4,834,938 | 5/1989 | Pyzik et al. | 419/6 |
| 4,961,778 | 10/1990 | Pyzik et al. | 75/230 |
| 5,039,633 | 8/1991 | Pyzik et al. | 501/93 |
| 5,145,504 | 9/1992 | Pyzik et al. | 75/230 |
| 5,197,528 | 3/1993 | Burke | 164/97 |
| 5,238,883 | 8/1993 | Newkirk et al. | 501/87 |
| 5,435,966 | 7/1995 | Johnson et al. | 419/47 |

OTHER PUBLICATIONS

D. Briggs, M. P. Seah, "*Practical Surface Analysis*", John Wiley and Sons, New York, Dec. 1983, pp. 6–8.

Joachim Stohr, "*NEXAFS Spectroscopy*" Springer–Verlag, Berlin Heidelberg, Dec. 1992, pp. 4–8.

U.S. patent application Ser. No. 07/736,991 filed Jul. 29, 1991.

U.S. patent application Ser. No. 07/671,580 filed Mar. 19, 1991.

U.S. patent application Ser. No. 07/672,259 filed Mar. 20, 1991—Under Secrecy Order.

U.S. patent application Ser. No. 07/789,280 filed Nov. 6, 1991.

*Primary Examiner*—Donald P. Walsh
*Assistant Examiner*—John N. Greaves

[57] ABSTRACT

Subject boron carbide to a passivation treatment at a temperature within a range of 1350° C. to less than 1800° C. prior to infiltration with a molten metal such as aluminum. This method allows control of kinetics of metal infiltration and chemical reactions, size of reaction products and connectivity of $B_4C$ grains and results in cermets having desired mechanical properties.

14 Claims, No Drawings

LIGHT WEIGHT BORON CARBIDE/ALUMINUM CERMETS

The United States Government has rights to this invention pursuant to Contract Number N-66857-91-C 1034 awarded by Navy Ocean Systems Center, San Diego, Calif.

CROSS-REFERENCE TO RELATED APPLICATIONS

This application is a continuation-in-part of Application Ser. No. 08/154,904 filed Nov. 19, 1993, now U.S. Pat. No. 5,394,929 which is, in turn, a continuation-in-part of Application Serial Number 07/916,041 filed Jul. 17, 1992, and now abandoned.

BACKGROUND OF THE INVENTION

This invention relates generally to boron carbide/aluminum ($B_4C$/Al) cermets, their preparation and their use in applications requiring high resistance to applied pressures such as hydrostatic pressure applied to external surfaces of a submerged body. This invention relates more particularly to $B_4C$/Al cermets having an encapsulated void space and their preparation.

U.S. Pat. No. 4,605,440 discloses a process for preparing $B_4C$/Al composites that includes a step of heating a powdered admixture of aluminum and boron carbide at a temperature of 1050° C. to 1200° C. The process yields, however, a mixture of several ceramic phases that differ from the starting materials. These phases, which include $AlB_2$, $Al_4BC$, $AlB_{12}C_2$, $AlB_{12}$ and $Al_4C_3$, adversely affect some mechanical properties of the resultant composite. In addition, it is very difficult to produce composites having a density greater than 99% of theoretical by this process.

U.S. Pat. No. 4,702,770 discloses a method of making a $B_4C$/Al composite. The method includes a preliminary step wherein particulate $B_4C$ is heated in the presence of free carbon at temperatures ranging from 1800° C. to 2250° C. to provide a carbon enriched $B_4C$ surface having a reactivity with molten aluminum that is lower than $B_4C$ that is not carbon enriched. The lower reactivity minimizes the undesirable ceramic phases formed by the process disclosed in U.S. Pat. No. 4,605,440. During heat treatment, the $B_4C$ particles form a rigid network. The network, subsequent to infiltration by molten aluminum, substantially determines mechanical properties of the resultant composite. At temperatures in excess of 2000° C., carbon distribution tends to be variable which leads, in turn, to different rates and degrees of sintering. The latter differences may result in cracking of parts having a thickness of 0.5 inch (1.3 cm) or greater.

U.S. Pat. No. 4,718,941 discloses a method of making metal-ceramic composites from ceramic precursor starting constituents. The constituents are chemically pretreated, formed into a porous precursor and then infiltrated with molten reactive metal. The chemical pretreatment alters the surface chemistry of the starting constituents and enhances infiltration by the molten metal. Ceramic precursor grains, such as boron carbide particles, that are held together by multiphase reaction products formed during infiltration form a rigid network that substantially determines mechanical properties of the resultant composite.

SUMMARY OF THE INVENTION

A first aspect of the present invention is a method for making a boron carbide/aluminum alloy composite, the method comprising infiltrating a molten aluminum alloy into a boron carbide preform using an infiltration temperature within a range of from 850° C. to less than 1200° C. and an infiltration time sufficient to form a boron carbide/aluminum alloy composite.

In a second aspect, related to the first aspect, boron carbide powder is passivated prior to infiltration at a temperature of from about 1350° C. to less than 1800° C. in an environment that is devoid of added free carbon for a period of time sufficient to reduce reactivity of the boron carbide with the molten aluminum alloy.

As used herein, the phrase "an environment that is devoid of added free carbon" means that neither non-gaseous sources of carbon, such as graphite, nor gaseous sources of carbon, such as a hydrocarbon, are deliberately placed in contact with the $B_4C$ preform during heat treatment. Those skilled in the art recognize that very small amounts of carbon monoxide are inherently present in some furnaces, such as a graphite furnace, due to graphite heating elements, graphite furniture or both. They also recognize that use of a different type of furnace, such as one heated by a tungsten or a molybdenum heating element, effectively eliminates carbon monoxide. The small amounts of carbon monoxide are not, however, of concern as results are believed to be independent of the type of furnace and the presence or absence of small amounts of carbon monoxide. In other words, no attempt is made to enrich the carbon content of the $B_4C$.

In a third aspect, related to either the first or the second aspect, the boron carbide/aluminum alloy composite is subjected to a post-infiltration heat treatment step wherein the boron carbide/aluminum alloy composite is heated at a temperature within a range of from about 625° C. to less than 1200° C. for a period of time within a range of from about 1 to about 50 hours.

A fourth aspect of the invention includes boron carbide/aluminum alloy composites formed by the process of any of the first, second or third aspects. The fourth aspect particularly includes shaped composites having an internal void space. The composites are suitable for use in applications requiring light weight, high flexure strength and an ability to maintain structural integrity in a high compressive pressure environment. Buoyancy spheres for offshore deep water oil drilling apparatus or for underwater cable and pressure housings for underwater vehicles are examples of articles used in high compressive pressure environments. A skilled artisan can readily discern other examples without undue experimentation.

DETAILED DESCRIPTION

Boron carbide, a ceramic material characterized by high hardness and superior wear resistance, is a preferred material for use in the process of the present invention.

An alloy of aluminum (Al), a metal used in ceramic-metal composites (cermets) to impart toughness or ductility to the ceramic material is a second preferred material. There are many commercial Al alloys, each of which is designed to meet specific service and production needs. For example, some alloys may be readily extruded or rolled into sheets and plates, but unsuitable for use in making coatings. With only a few exceptions, a given alloy is typically not used both for wrought products and for casting. In addition, certain alloys are especially suited for machining, welding, cold forming or other manufacturing operations.

Al alloy properties depend largely upon chemical composition and tempering or heat treating processes used to fabricate a given alloy. All alloys are very carefully designed and even a slight change in composition leads to changes, sometimes significant, in alloy properties. Stated differently, using a commercial Al alloy under conditions that differ from those for which it was designed often leads to expected, but unpredictable, changes in properties and behavior.

One source of composition changes stems from evaporation of low melting alloying constituents such as zinc (Zn) and magnesium (Mg). In fact, when an Al alloy that contains both Zn and Mg (such as 7075 that has a Zn content of 5–6% by weight (wt %) and a Mg content of about 2.5% by weight) is heated to a suitable infiltration temperature (above 1100° C.), essentially all Zn and Mg disappears. This change in composition necessarily leads to physical property and performance changes.

A second source of composition changes is a loss of alloy constituents due to their reaction with aluminum-boron-carbon (Al—B—C) phases. For example, common Al alloy constituents such as chromium (Cr) or iron (Fe) react with Al and B to form Cr— and Fe-rich Al $B_2$. As with volatilization, this also leads to physical property and performance changes.

Reactions of some Al alloy constituents with other alloy constituents provide a third source of composition changes. For example, at temperatures above 1000° C., constituents, such as zirconium (Zr), silicon (Si), titanium (Ti) and Fe, react to form intermetallics such as TiZr and metal silicides. Some of these constituents also react with B or C to form metal borides or metal carbides.

Although tempering may be possible for some Al alloys, boron carbide-Al ceramic-metal composites (cermets) cannot be tempered. Tempering requires rapid cooling, also known as quenching. Cermets cannot be quenched.

The composition changes due to volatilization, reaction or both during preparation of a cermet via infiltration effectively render manufacturer specifications for Al alloys meaningless and their suitability in making an acceptable cermet uncertain. Small changes in Al alloy composition unexpectedly lead to large performance differences in cermets prepared from such alloys.

Al alloys that yield high compressive strengths desirably comprise Al and at least one other metal selected from the group consisting of Si, Cu, Cr, Fe, manganese (Mn), Ti and, optionally, magnesium (Mg), zinc (Zn) or both Mg and Zn. The alloys preferably have a composition that comprises from about 0.2 to about 4 wt % Si; from about 0.2 to about 0.5 wt % Fe; from about 0.1 to about 0.4 wt % Cr; from greater than 0 to less than about 1 wt % Cu; manganese (Mn) and Ti, each less than 400 parts per million (ppm); and Al greater than about 94 wt %. All amounts are based upon total alloy weight and add up to 100 wt %.

The process aspect of the invention begins with a porous body preform or greenware article. Greenware can be prepared from $B_4C$ powder either with or without a passivation pretreatment. Passivation of $B_4C$ powder occurs in an atmosphere that is devoid of free carbon by milling it in a ball mill, preferably a graphite ball mill, at temperatures above 1300° C., preferably within a range of from about 1400° C. to about 1550° C. Temperatures in excess of 1550° C. tend to promote undesirable agglomeration and necking of $B_4C$ grains. Milling times at these temperatures desirably fall within a range of from about 15 minutes to about four hours, preferably within a range of from about one to about two hours.

Although greenware prepared from unpassivated $B_4C$ powder may be passivated as described hereinafter, there are several advantages to passivating powder rather than a preform. One advantage is that the powder may be formed into a desired shape merely by simple dry pressing. Another advantage is that the passivated powder may be mixed with at least one other ceramic powder before being converted into a preform. A further advantage is that passivated $B_4C$ powder grains can be mixed with metal powders other than Al to slow down or otherwise modify chemical reactions that occur during infiltration or via post-infiltration treatments. Such other metal powders include cobalt (Co), chromium (Cr), iron (Fe), hafnium (Hf), manganese (Mn), molybdenum (Mo), niobium (Nb), nickel (Ni), silicon (Si), tantalum (Ta), titanium (Ti), vanadium (V), tungsten (W), and zirconium (Zr).

Greenware preforms are prepared from $B_4C$ powder by conventional procedures. These procedures typically include slip casting a dispersion of the ceramic powder in a liquid or applying pressure to powder in the absence of heat. Although any $B_4C$ powder may be used, the $B_4C$ powder desirably has a particle diameter within a range of 0.1 to 5 micrometers (μm). Ceramic materials in the form of platelets or whiskers may also be admixed with $B_4C$ powder and, if appropriate, other ceramic powders, metal powders or both.

The porous $B_4C$ preform may be used or infiltrated as prepared (without any preheating or baking). The preform, whether shaped or not, may be passivated by heating it to a temperature within a range of from about 1350° C. to less than 1800° C. in an environment that is devoid of free carbon. The preform is maintained at about that temperature for a period of time sufficient to reduce reactivity of the $B_4C$ with molten Al alloy. The time is suitably within a range of from about 15 minutes to about 4 hours. Passivating (heating) times in excess of 4 hours are uneconomical as they do not provide any substantial increase in physical properties of cermets or composites prepared from the preforms. The range is preferably from about 15 minutes to about two hours. The preform may also be shaped prior to infiltration.

When $B_4C$ is passivated at temperatures above 1350° C. but less than 1800° C., it yields observable changes in reactivity between an Al alloy and a passivated $B_4C$ preform relative to reactivity between an unpassivated $B_4C$ preform and the same Al alloy. The changes are visible in optical and scanning electron micrographs (SEM) of polished samples of resulting $B_4C$/Al alloy cermets. High temperature differential scanning calorimetry (DSC) can be used to determine unreacted Al alloy metal contents. As the passivation temperature increases from about 1350° C. to about 1400° C., an increase in amount of unreacted Al alloy occurs concurrent with a rapid reduction in chemical reaction kinetics. At temperatures of from greater than about 1400° C. to less than 1800° C., the amount of unreacted Al alloy remains relatively constant.

As $B_4C$ is subjected to passivation, $B_4C$ surface carbon contents, as determined by x-ray photoelectron spectroscopy (XPS) at room temperature subsequent to heat treatment, remain relatively constant up to about 1900° C. D. Briggs et al., ed., in Practical Surface Analysis by Auger and X-ray Photoelectron Spectroscopy, John Wiley and Sons (New York, 1983), provide a general introduction to XPS at pages 6–8 and a more detailed explanation of XPS in sections 3.4, 5.3 and 5.4 and in chapter 9. The relevant teachings of D. Briggs et al. are incorporated herein by reference. XPS collects emitted electrons from a sample at a depth of 60 to 70 Å (6–7 nm). At temperatures in excess of 1900° C., the $B_4C$ surface carbon content increases rapidly.

U.S. Pat. No. 4,702,770 teaches that particulate $B_4C$ should be heated in the presence of free carbon to 1800°

C.–2250° C. to reduce reactivity of the $B_4C$ with Al. It is believed that when excess carbon is present during heat treatment at temperatures below 1800° C., the carbon does not react with the $B_4C$ to modify its surface, but remains as free carbon. When contacted with molten Al alloy during infiltration, the free carbon reacts with Al to form $Al_4C_3$, a very undesirable reaction product.

In accordance with the invention, passivation occurs in the absence of free carbon. This produces preforms that are cleaner and less susceptible to $Al_4C_3$ formation than would be the case if the preforms were heated or passivated at the same temperatures in the presence of free carbon.

Although $B_4C$ surface carbon contents remain virtually constant with heat treatments in accordance with the present invention at temperatures of from 1250° C. to less than 1800° C., XPS characterization techniques show that $B_4C$ surface boron contents do not. As the passivation temperature increases from about 1300° C. to about 1400° C., the surface boron content decreases sharply. As the passivation temperature continues to increase to about 1600° C., surface boron content remains essentially constant. A gradual decline in surface boron content occurs as the passivation temperature increases from 1600° C. to less than 1800° C. An even more gradual decline occurs as heat treatment temperatures increase to about 2000° C.

It has been discovered, via near edge x-ray absorption fine structure (NEXAFS) methodology, that two different forms of surface boron are present, particularly in preforms that are subjected to a passivation treatment temperatures within a range of 1250° C. to 1400° C. One form, designated as B3', is more reactive than the other, designated as B3. At passivation temperatures in excess of 1400° C., B3' content is at or near zero and any surface boron is substantially in the B3 form. NEXAFS is described by Joachim Stohr in NEXAFS Spectroscopy, Springer-Verlag, Berlin (1992), at pages 4–8 and chapters 4 and 5 and by F. Brown et al., in Physical Review Bulletin, volume 13 at page 2633 (1976). The relevant teachings of these references are incorporated herein by reference.

NEXAFS allows measurement of the absorption of x-rays as a function of energy. Either emitted x-rays (fluorescence yield or FY) or emitted electrons (EY) produce signals that are proportional to absorption strength. EY and FY are detected simultaneously. FY gives information about bulk characteristics due to the long mean free path (about 50 to 2000 Å or 5 to 200 nm) of x-rays in the material. EY gives information related to surface species (about 30 Å (3 nm)) due to the short mean free path of electrons.

Analysis of bulk x-ray diffraction patterns does not show any difference in boron carbide structure based upon passivation temperature. This analysis agrees with the B-C phase diagram that is constructed based upon bulk chemistry data and predicts no changes below 2000° C. FY spectra are believed to be bulk sensitive since signals are gathered from a depth of several hundred angstroms in the case of carbon and as much as 2000 Å (200 nm) in the case of boron. As such, signals arising within the first few angstroms of the surface of a sample are believed to be overwhelmed by the signals coming from deeper in the sample.

Passivation treatments change chemical reactivity between $B_4C$ and Al alloy and affect the grain size of, or volume occupied by, reaction products or phases that result from reactions between $B_4C$ and Al alloy. In the absence of passivation or with passivation at a temperature below 1250° C., comparatively large clusters of $AlB_2$ and $Al_4BC$ form. Although $B_4C$ grains have an average size of about 3 μm, an average cluster of $AlB_2$ or $Al_4BC$ may reach 50 to 100 μm. Clusters of grains consisting of one phase (such as $Al_4BC$) are believed to have grain boundaries with clusters of grains consisting of another phase (such as Al $B_2$) that are free of metallic Al alloy. In this manner, a continuous network of connected large ceramic clusters is believed to form. Large clusters of grains of $Al_4BC$ are particularly detrimental because $Al_4BC$ is more brittle than $B_4C$ or Al. Large grains also affect fracture behavior and contribute to low strength (less than 45 ksi (310 MPa)) and low fracture toughness ($K_{IC}$ values of less than 5 $MPa \cdot m^{1/2}$). Heat treatments at 1300° C. for longer than one hour, preferably at least two hours, lead to reductions in $Al_4BC$ grain size to less than 5 μm, frequently less than 3 μm. Concurrent with the grain size reductions, the strength and toughness increase. The reduced grain size and increased strength (from about 600 to about 700 MPa) and toughness (from 6 to about 8 $MPa \cdot m^{1/2}$) can be maintained with passivation temperatures as high as 1400° C. provided treatment times do not exceed five hours. As temperatures increase above 1400° C. or treatment times at 1400° C. exceed five hours, $Al_4BC$ grains tend to grow and form elongated, cigar-shaped grains having an average diameter of 3–8 μm and a length of 10–25 μm. The size of $Al_4BC$ "cigars" increases as temperature increases up to a maximum at a temperature of about 1750° C. to 1800° C. The elongated $Al_4BC$ grains or "cigars" tend to be surrounded by Al metal and are believed to act as an in-situ reinforcement as cermets produced from $B_4C$ that is passivated at temperatures of from 1700° C. to less than 1800° C. tend to have higher fracture toughness values than cermets prepared from $B_4C$ that is subjected to other heat treatment temperatures. At temperatures above 1800° C., larger clusters, similar to those observed with passivation at temperatures below 1250° C., begin to form.

Passivation does not require the presence of carbon. In fact, carbon is an undesirable component as it leads to an increase in formation of $Al_4C_3$ when it is present. $Al_4C_3$ is believed to be an undesirable phase because it hydrolyzes readily in the presence of normal atmospheric humidity. Accordingly, the $Al_4C_3$ content is beneficially less than 1% by weight, based upon composite weight, preferably less than 0.1% by weight.

Composite physical properties are also affected by $B_4C$ content. As the volume percent of $B_4C$ decreases from about 80 volume percent to about 55 volume percent, based upon total composite volume, toughness increases from about 6 to about 12 $MPa \cdot m^{1/2}$.

Infiltration of a preform that is passivated at a temperature of greater than 1350° C. to less than 1800° C. occurs faster and at lower temperatures than in an unheated preform. For example, passivation at 1400° C. for two hours reduces temperatures needed for infiltration to less than 1000° C. If infiltration occurs at a higher temperature such as 1160° C., infiltration tends to be complete much faster than in a preform that is either unpassivated or formed from unpassivated $B_4C$. In addition, the heat treated preform is easier to handle than the unheated preform and may even be machined or subjected to other shaping operations prior to infiltration.

Conventional procedures such as vacuum infiltration, inert gas infiltration or pressure-assisted infiltration may be used to infiltrate molten Al alloy into passivated porous preforms. Although vacuum infiltration is preferred, any technique that produces a dense cermet body may be used. Infiltration preferably starts at about 850° C. and finishes below 1200° C. as infiltration at or above 1200° C. leads to formation of large quantities of $Al_4C_3$.

Three primary benefits flow from passivation at a temperature of from about 1350° C. to less than 1800° C. One benefit is that infiltration becomes possible below 1000° C. A second benefit is that infiltration below 1200° C. occurs more rapidly than in the absence of passivation. Finally, some measure over control of the microstructure of resulting $B_4C$/Al cermets becomes possible.

Factors contributing to control of the microstructure include variations in (a) amounts and sizes of resultant reaction products or phases, (b) connectivity between adjacent $B_4C$ grains, and (c) amount of unreacted aluminum. Control of the microstructure leads, in turn, to control of physical properties of the cermets. This is in contrast to infiltration of green (unpassivated) $B_4C$ preforms, a technique that does not provide control over the amount and morphology of reaction phases. It is also in contrast to infiltration of $B_4C$ that is sintered at temperatures above 1800° C. The latter technique provides no more than limited control over $B_4C$ network connectivity and does not allow one to control morphology of reaction phases. One can therefore produce near-net shape parts with improved mechanical properties without sintering $B_4C$ preforms at temperatures above 1800° C. prior to infiltration. The production of near-net shapes below 1800° C. eliminates problems such as warping and cracking of preforms at high temperatures and costly shaping operations subsequent to preparation of the cermets. Unique combinations of properties may also result, such as high compressive strength (≧3 GPa), high flexure strength (≧600 MPa) and fracture toughness (≧6 MPa·$m^{1/2}$) in conjunction with low theoretical density (≦2.65 g/cc). Cermet materials prepared from passivated $B_4C$ in accordance with the present invention are believed to have higher strength and toughness than those prepared from unpassivated $B_4C$. In addition, they are believed to have higher strength, toughness and hardness than cermets prepared from $B_4C$ that is sintered at temperatures above 1800° C. When such cermets are compared on the basis of the same initial $B_4C$ content.

The cermets, especially those prepared by subjecting a boron carbide preform to passivation at a temperature within a range of from about 1350° C. to less than 1800° C., are desirably given a post-infiltration heat treatment. The heat treatment desirably occurs at a temperature within a range of from about 625° C. to less than 1200° C. and for a period of time within a range of from about 1 to about 50 hours. The temperature is preferably within a range of from about 650° C. to about 700° C.

The cermets (boron carbide/aluminum alloy composites) prepared in accordance with the invention desirably have, prior to a post-infiltration heat treatment as described herein, a boron carbide content within a range of from about 55 to about 80 volume percent and an aluminum alloy content within a range of from about 45 to about 20 volume percent. The boron carbide and aluminum alloy contents total 100 volume percent. The volume percentages are based upon total cermet volume. The cermets typically have a density of from about 2.5 to about 2.7 g/$cm^3$, preferably from about 2.55 to about 2.65 g/$cm^3$; a Young's Modulus of from about 220 to about 380 gigapascals (GPa) or greater, preferably about 360 GPa or greater; a compressive strength of from about 3 to about 6 GPa, preferably greater than about 3.8 GPa. It is believed that within these ranges, higher values are more typical of cermets subsequent to a post-infiltration heat treatment as described herein and lower values generally represent cermets prior to such a heat treatment. The post-infiltration heat treatment reduces the Al alloy content of the cermets to a residual Al alloy content and changes composition of said residual Al alloy in comparison to the Al alloy prior to the post-infiltration heat treatment. It is also believed that when such a residual alloy contains both Al and Si and has a composition approaching that of an Al—Si eutectic composition, the physical properties of resulting cermets are better than when the residual alloy composition is quite distant from said eutectic composition.

The following examples further define, but do not limit the scope of the invention. Unless otherwise stated, all parts and percentages are by weight.

EXAMPLE 1

Boron carbide ($B_4C$) manufactured by ESK (Electroschmelzwerk Kempten of Munich, Germany), and having particles ranging from 0.1 to 10 micrometers (μm) is dispersed in distilled water to form a suspension or slip having a solids content of 40 percent by volume (vol-%), based upon total suspension volume. The slip is stirred for 4–5 hours and then ball milled for 12 hours with $B_4C$ media. During stirring and milling, $NH_4OH$ is added as needed to maintain the slip at a pH of 7.

USG No. 1 pottery plaster is used to make cylindrical molds with an inner diameter slightly greater than a desired outer diameter for a finished part. Preparation of a five inch (12.7 cm) tall pressure housing cylinder via casting requires a single, vertical mold with a height of 6 inches (15.2 cm) whereas a pressure housing having a height of 9 inches (22.9 cm) requires a vertical stacking of two of the 6 inch (15.2 cm) molds. In both cases, sealing of mold bottoms prevents loss of slip via leakage. The molds are dried in a 50° C. oven for a minimum of 24 hours before use.

Before casting $B_4C$ cylinders from the slip, the slip is degassed to remove any air introduced by stirring and milling. The mold is conditioned before addition of the slip by filling it with distilled water for about 45 seconds after which the distilled water is poured out of the conditioned mold. The slip is poured slowly into the conditioned mold to minimize introduction of air into the slip and allowed to remain in the mold for a period of from 2 to 2.5 hours to form a casting. The period varies with desired casting wall thickness. Excess slip is then poured from the mold and the mold and cast wall are allowed to air dry until the casting is dry enough to not to slump following mold removal.

After carefully removing the mold from the casting, the casting is placed into a low temperature oven at 45° C. for 24 hours. The casting is then subjected to an additional low temperature (75–85° C.) vacuum treatment for 24 hours to ready the cylinder for passivation and infiltration.

The castings are passivated by baking them (in a flowing argon atmosphere) at a temperature of 1400° C. for 2 hours in a graphite element furnace. The passivated cylinders are then infiltrated with a molten Al alloy. One alloy (hereinafter "Alloy A") is a specification 6061 alloy, manufactured by Aluminum Company of America. It is a commercial grade of aluminum alloy and contains 0.7% Si, 0.5% Fe, 0.2% Cu, 0.1% Mn, 1.2% Mg, 0.3 % Cr, 0.25% Zn and 0.15 % Ti. A second alloy (hereinafter "Alloy B") is a specification 1350 alloy, also manufactured by Aluminum Company of America. It is also a commercial grade of aluminum alloy and contains 0.2 % Si and 0.4 % Fe. Infiltration occurs at ambient pressure or vacuum of about 150 millitorr (13.3 Pa) at 1180° C. for 105 minutes. After infiltration, the castings (now in the form of hollow cylinders) are subjected to a post-infiltration heat treatment at a temperature of 695° C. for 50 hours. The heat-treated hollow cylinders have an outer diameter of 6 inches (15.2 cm), a length of 5 inches (12.7 cm), and a wall thickness of 0.138 inch (0.35 cm).

Two hollow cylinders are, subsequent to having both ends enclosed with titanium joint rings that are bonded to cylinder end surfaces with an epoxy resin and being instrumented with electric resistance strain gauges CEA-06-125 WT-350 (Micromeritics Inc.) and an acoustic resistance transducer, subjected to external pressure testing. One hollow cylinder (Cylinder A) is infiltrated with Alloy A and the other (Cylinder B) is infiltrated with Alloy B. Both cylinders have a wall thickness of 0.138 inch (0.35 cm) and a height of five inches (12.7 cm). Testing occurs in a pressure vessel that is fitted with an electrical connector through which the strain and acoustic signals pass to an external monitor. Pressure increases occur gradually until implosion takes place. Cylinder A implodes at a pressure of 19,600 psi (135 MPa) and has a maximum compressive hoop stress of 429,000 psi (2960 MPa). Cylinder B implodes at a pressure of 13,400 psi (92 MPa) and has a maximum compressive hoop stress of 293,000 psi (2020 MPa).

Composition analysis of Cylinder A prior to the 695° C. post-infiltration heat treatment shows that it consists of 65–68% $B_4C$, 8–11% reaction phases and about 24 % free Al metal. The amount of metals other than Al is: 0.7% Si, 0.4 % Fe, 0.2 % Cr and about 400 parts per million (ppm) Mn. This represents a substantial change from the initial Al alloy composition. Further changes in metal content occur with the 695° C. post-infiltration heat treatment. Although the free Al content is reduced to about 6 vol-%, only very minor amounts of the Fe and Cr react with ceramic phases. As such, a ratio of free Al to alloying metals (Fe, Cr, Si and Mn) in a post-infiltration heat-treated material differs substantially both from that present in the starting Al alloy and in the cylinder prior to the post-infiltration heat treatment.

Composition analysis of Cylinder B prior to the 695° C. post-infiltration heat treatment shows that it consists of 65–68% $B_4C$, 8–11% reaction phases and about 24 % free Al metal. The amount of metals other than Al is: 0.16% Si; and 0.38% Fe. The heat-treatment at 695° C. reduces free Al to about 7 % and causes most of the Si and Fe to react and form iron silicides thereby resulting in almost pure aluminum.

This example shows that Al alloy composition changes substantially during processing, resulting in a ratio of Al to other metals that is unusually low when compared to typical commercial Al alloys. It also shows that retention of alloying metals subsequent to infiltration and a post-infiltration heat treatment is important in order to maximize compressive strength. Cylinder A, for example, has a post-infiltration heat treatment metal content wherein metals other than Al constitute in excess of 10 vol-% of total metal content whereas Cylinder B has a metal content that is nearly pure Al. Similar results are expected with other Al alloys that yield an alloying metal content at least as high as that of Alloy A subsequent to a post-infiltration heat treatment as in this example.

EXAMPLE 2

Boron carbide slurry, prepared as in Example 1, is poured into several plaster molds having cavities shaped as hemispheres. The molds are conditioned with distilled water as in Example 1 prior to being filled with the slurry. A casting time of two minutes yields hemispherical castings having a diameter of three inches (7.6 cm) and a wall thickness of about 1 millimeter (mm). The castings are dried for 24 hours in 50° C. and then passivated by baking at 1400° C. as in Example 1 save for reducing the baking time to one hour. Infiltration and post-infiltration heat-treatment of the castings also occurs as in Example 1 save for replacing Alloy B with Alloy C. Alloy C is a specification 1145 commercial Al alloy manufactured by Aluminum Company of America that contains 0.4 vol-% combined Si and Fe content and 99.6 vol-% Al.

Grinding of ring-shaped hemisphere surfaces flattens the surfaces and facilitates joining two hemispheres with an epoxy to form a hollow sphere. The hollow spheres are subjected to compressive strength testing as in Example 1. A hollow sphere prepared using Alloy A with a residual alloying metal content approximating that of Cylinder A in Example 1 withstands an external pressure of 300,000 psi (2070 MPa). A hollow sphere prepared using Alloy C, on the other hand, has a residual metal content approximating pure Al and withstands an external pressure of only 180,000–220,000 psi (1240–1520 MPa). As in Example 1, a beginning alloying metal content that yields a sufficient residual alloying metal content after processing as in this example leads to higher compressive strength values than Al alloys that do not provide such residual alloying metal contents. Similar results are expected with Al alloys that provide residual alloying metal contents like that of Alloy A or even greater under conditions similar to those described herein.

EXAMPLE 3

Boron carbide slurry, prepared as in Example 1, is cast into blocks having a density of 70–71 % of theoretical density using 8 inch×2 inch×0.25 inch (20.3 cm by 5.1 cm by 0.6 cm) molds. After drying for 24 hours at 50° C., the blocks are machined into bars measuring 0.25×0.25×8 inches (0.6 cm by 0.6 cm by 20.3 cm). A different set of five of these bars is passivated at each of 1000° C., 1200° C., 1300° C. and 1400° C. Another set of five bars receives no baking (represented in Table I below as 20° C.).

Infiltration of the bars occurs by orienting one bar from each set vertically so that one end of each bar rests on solid aluminum metal. The arrangement of bars and aluminum metal is placed into a graphite element furnace and heated to a temperature of 1160° C. in vacuum (about 100 militorr) for a specified time interval before it is cooled to room temperature and the bars are inspected. A different set of bars is used for each specified time interval. The specified time intervals are 10, 30, 60, 120 and 180 minutes. The inspection consists of sectioning the bars to allow a determination of depth of metal penetration. Table I below presents results of the inspection.

TABLE I

Effect of Passivation Temperature on Infiltration Depth

| Passivation Temp. | Penetration Depth (cm) after infiltration time (minutes) | | | | | | |
|---|---|---|---|---|---|---|---|
| (°C.) | 10 | 20 | 30 | 45 | 60 | 90 | 120 |
| 20 | 5 | 7 | N/A | 10 | 12.5 | 15 | 17 |
| 1000 | 5 | N/A | 8 | 10 | 11 | N/A | 16 |
| 1200 | N/A | N/A | 8 | 10 | 11 | N/A | 17 |
| 1300 | 6 | 8 | 10 | 12 | 14 | 17 | 19 |
| 1400 | 13 | 17 | 21 | N/A | N/A | N/A | N/A |

The data presented in Table I demonstrate that infiltration kinetics for penetration of an Al alloy into a porous $B_4C$ ceramic body remain largely unaffected by temperature until the temperature exceeds 1300° C. In fact, a significant increase in depth of penetration occurs at 1400° C. as compared to penetration at 1300° C. or below. Similar results are expected with other Al alloys and $B_4C$ powders under the same or similar conditions.

EXAMPLE 4

Small $B_4C$ pellets having a diameter of one inch (2.5 cm) are fabricated from a slurry prepared as in Example 1. The pellets are divided into two equal portions. One portion is passivated at 1425° C. for 1 hour. The other portion is used as fabricated. Each portion is further subdivided into equal subportions. An amount (Table II) of Alloy C is placed on each subportion. A tungsten heating element furnace heats subportions and associated Al alloy amounts under a high vacuum of $10^{-6}$ torr to a specified temperature (Table II). The furnace is equipped with a sight port to allow observation and recording of infiltration. Heating occurs according to the following schedule: (i) heat from room temperature (nominally 20° C.) to 600° C. at a rate of 20° to 25° C./minute; (ii) hold at 600° C. for 30 minutes to allow the vacuum to stabilize; (iii) heat from 600° C. to the specified temperature at a rate of 100 ° C./minute; and (iv) hold at the specified temperature until infiltration of the Al alloy into the pellets is complete. Table II below summarizes data in terms of amount (weight) of Al alloy, specified temperature and time of infiltration.

TABLE II

Effect of Passivation Upon Speed of Infiltration

| Specified Temperature (°C.) | Passivated | Al Alloy Weight (gms) | Time to Complete Infiltration (min) |
|---|---|---|---|
| 1000 | Yes | 0.55 | 27 |
| 1000 | No | 0.55 | 63 |
| 1000 | Yes | 0.72 | 30 |
| 1000 | No | 0.72 | 45 |
| 1100 | Yes | 0.15 | 5 |
| 1100 | No | 0.15 | 14 |
| 1100 | Yes | 0.73 | 7.5 |
| 1100 | No | 0.73 | 15.5 |
| 1100 | Yes | 1.25 | 6 |
| 1100 | No | 1.25 | 17 |

The data presented in Table II demonstrate that infiltration occurs more rapidly in passivated pellets than in those that are not passivated. In addition, differences in infiltration speed become more pronounced as the specified temperature increases. At temperatures below 1000° C., experimental procedures are not accurate enough to quantify differences in infiltration speed. Similar results are expected with other Al alloys and $B_4C$ powders.

EXAMPLE 5

A 1.0 kilogram (kg) quantity of $B_4C$ powder (ESK 1500) is loaded into an 8 inch (20.3 cm) inside diameter (I.D.) by 10 inch (25.4 cm) deep graphite crucible that is placed, in turn, into a batch rotary induction furnace. The crucible is inclined at an angle of 22.5° (with respect to horizontal). The crucible is fitted with 6 graphite lifts to aid in powder turnover and mixing. During heating, soaking, and cooling the crucible is rotated at three revolutions per minute (rpm).

After loading the crucible into the furnace, the furnace is closed, purged with nitrogen at a flow rate of 20 standard liters per minute (slpm) for 60 minutes before initiating heating in the presence of a flowing nitrogen atmosphere (10 slpm) to passivate the $B_4C$ powder. Passivation occurs via the following heat treatment schedule: (i) heat at 30° C. per minute to a temperature within a range of 1400–1550° C., (ii) hold at that temperature for 2 hours, and (iii) allow the furnace and its contents to cool to room temperature via natural cooling.

The passivated boron carbide powders are pressed into 1 inch (2.5 cm) diameter pellets and infiltrated with Al at 1160° C. for 30 minutes. An inspection of polished sections taken from the pellets shows that reaction phase content and number is low. The inspection reveals an amount of unreacted metal similar to that contained in parts fabricated from shaped and passivated greenware. This example shows that $B_4C$ powder can be passivated before shaping it into porous part. This eliminates grinding a passivated greenware part and provides an economically viable alternative method to prepare $B_4C$ preforms.

EXAMPLE 6

Two batches of pellets are formed as in Example 5 from an admixture of $B_4C$ powder and a metal in a volumetric ratio of $B_4C$ powder to metal of 75:25. In one batch (Batch A), the $B_4C$ powder is passivated as in Example 5. In the other batch (Batch B) the $B_4C$ powder is used as received. The metal is Al, Ti or Mn. Each batch of pellets is placed into a graphite element furnace and heated in vacuum ($10^{-3}$ Torr) to 900° C. and maintained at that temperature for four hours. After cooling to room temperature, each pellet is crushed and analyzed by differential scanning calorimetry (DSC) to determine an amount of unreacted Al and by x-ray diffraction (XRD) to provide an estimate of amounts of unreacted Ti and Mn.

The pellets prepared from passivated $B_4C$ powder (Batch A) have residual metal contents as follows: 21% Al; 17% Mn; and 16% Ti. The pellets prepared from unpassivated $B_4C$ powder (Batch B) have residual metal contents as follows: 9% Al; 10% Mn; and 7% Ti. The data show lower reactivity of each of the metals when the $B_4C$ is passivated. This example suggests that passivation of $B_4C$ surfaces can slow down chemical reactivity with chemically reactive metals such as Ti, Mn, Fe, Co, Cr, Hf, Mo, Nb, Ni, Si, Ta, V, W and Zr. Similar results are expected with such reactive metals other than Ti and Mn as well as with other $B_4C$ powders.

What is claimed is:

1. A method for making a boron carbide/aluminum alloy composite, the method comprising infiltrating a molten aluminum alloy into a preform of boron carbide using an infiltration temperature within a range of from 850° C. to less than 1200° C. and an infiltration time sufficient to form a boron carbide/aluminum alloy composite wherein the boron carbide is passivated prior to infiltration at a temperature of from about 1350° C. to less than 1800° C. in an environment that is devoid of free carbon for a passivating period of time sufficient to reduce reactivity of the boron carbide with the molten aluminum alloy.

2. The method of claim 1, wherein the passivating period of time is within a range of from about 15 minutes to about 4 hours.

3. The method of claim 1 further comprising a step wherein the preform is fabricated from passivated boron carbide powder.

4. The method of claim 3, wherein boron carbide powder is passivated in an environment devoid of free carbon during milling in a graphite mill at a temperature within a range of from about 1350° C. to less than 1800° C. and for a period of time within a range of from about 15 minutes to about 4 hours.

5. The method of claim 4, wherein the temperature is within a range of from about 1400 to about 1550° C. and the time is within a range of from about 1 to about 2 hours.

6. The method of claim 1 further comprising a post-infiltration heat treatment step wherein the boron carbide/aluminum alloy composite is heated at a temperature within a range of from about 625° C. to less than 1200° C. for a period of time within a range of from about 1 to about 50 hours.

7. The method of claim 6, wherein the temperature is within a range of from about 650° C. to about 700° C.

8. The method of claim 3, wherein the passivated boron carbide is admixed with at least one metal selected from the group consisting of cobalt, chromium, iron, hafnium, manganese, molybdenum, niobium, nickel, silicon, tantalum, titanium, vanadium, tungsten and zirconium before fabricating the preform.

9. The method of claim 1, wherein the composite has, as an initial composition prior to post-infiltration heat treatments, a boron carbide content within a range of from about 55 to about 80 volume percent and an aluminum alloy content within a range of from about 45 to about 20 volume percent, the boron carbide and aluminum alloy contents totaling 100 volume percent and the volume percentages being based upon total composite volume.

10. The method of claim 1, wherein the preform is subjected to shaping operations prior to infiltration.

11. The method of claim 10, wherein the shaping operations yield a preform having an internal void space.

12. A boron carbide/aluminum alloy composite prepared by the process of claim 11, the composite being a shaped body having an internal void space.

13. The composite of claim 12, wherein the internal void space has a volume sufficient to impart positive buoyancy to the body when said body is submerged in water.

14. A boron carbide/aluminum alloy composite prepared by the process of claim 1.

* * * * *